US005938416A

United States Patent [19]

Saito et al.

[11] Patent Number: 5,938,416

[45] Date of Patent: Aug. 17, 1999

[54] LIQUID TRANSFER APPARATUS HAVING A PLUNGER PUMP AND A DIAPHRAGM PUMP FOR CLEANING THE PLUNGER DURING ITS RECIPROCATING MOTION

[75] Inventors: Katsuhiko Saito, Otsu; Katsuaki Kaito, Nagaokakyo, both of Japan

[73] Assignee: Shimadzu Corporation, Kyoto, Japan

[21] Appl. No.: 09/034,360

[22] Filed: Mar. 4, 1998

[30] Foreign Application Priority Data

Mar. 7, 1997 [JP] Japan ..... 9-052627

[51] Int. Cl.[6] ..... F04B 23/04

[52] U.S. Cl. ..... 417/521; 417/199.1; 92/84; 92/130 C; 92/140

[58] Field of Search ..... 417/413.1, 415, 417/521, 199.1; 137/238; 92/130 C

[56] References Cited

U.S. PATENT DOCUMENTS

| | | | |
|---|---|---|---|
| 4,160,626 | 7/1979 | Bell | 417/403 |
| 4,197,787 | 4/1980 | Schneider | 92/129 |
| 4,627,798 | 12/1986 | Thomas | 417/415 |
| 4,790,236 | 12/1988 | Macdonald et al. | 92/129 |
| 5,505,593 | 4/1996 | Hartley et al. | 417/393 |
| 5,513,956 | 5/1996 | Lewis et al. | 417/12 |

*Primary Examiner*—Timothy S. Thorpe
*Assistant Examiner*—Ehud Gartenberg
*Attorney, Agent, or Firm*—Kanesaka & Takeuchi

[57] ABSTRACT

A liquid transfer pump includes a housing having an inner space, a cross head disposed in the inner space of the housing and attached to a driving mechanism to reciprocate inside the housing, a plunger attached to and held by a plunger holder of the cross head, and a pump head situated near the cross head. The pump head includes a pump chamber with an inlet path and an outlet path, and the plunger is disposed in the pump chamber to be reciprocated therein together with the cross head. A resilient O-ring is disposed in the plunger holder, and a plunger seal is disposed in the pump head, wherein one side of the plunger is engaged with and held by the resilient O-ring and the other side of the plunger is engaged with and held by the plunger seal. Accordingly, the plunger can be flexibly supported by the O-ring and the plunger seal. The plunger seal can be used for a long time without leakage.

8 Claims, 5 Drawing Sheets

LIQUID TRANSFER APPARATUS HAVING A PLUNGER PUMP AND A DIAPHRAGM PUMP FOR CLEANING THE PLUNGER DURING ITS RECIPROCATING MOTION

BACKGROUND OF THE INVENTION AND RELATED ART STATEMENT

The present invention relates to a liquid transfer pump mainly used for transferring a mobile phase or liquid to a column in a liquid chromatography, wherein, in particularly, axial centers of a plunger and a plunger seal always coincide with each other by a free movement of the plunger in the radial directions, so that the sealing life of the plunger seal is prolonged without damaging the plunger seal, and also, the plunger seal and a plunger end can be washed by water in case eluent containing salt as a mobile phase is used.

In the liquid chromatography, a mobile phase solvent to be transferred to a column is transferred by a pump. As a pump, a reciprocating type pump, i.e. piston type fixed flow amount pump or metering pump, which can provide a high pressure output with a precise flow amount, is most likely used.

In a piston type fixed flow amount pump or metering pump 40, as shown in an explanatory drawing in FIG. 5, for example, rotation of a driving motor 41 is transferred to an eccentric cam 43 to push a plunger 45 held by a plunger holder 42 through a follower 46, so that the mobile phase solvent is ejected with high pressure to a column side. Further, when the eccentric cam 43 rotates for 180 degrees, a return spring 44 pushes the plunger 45 backwardly, so that the mobile phase solvent is inhaled from a reservoir for the mobile phase into a pump chamber 40*a*. An inlet check valve 47 and an outlet check valve 48 are installed to prevent counter flows of the intake and output of the mobile phase solvent due to the reciprocal movements of the plunger 45.

In the reciprocal movements of the plunger, when the inner pressure in the pump chamber 40*a* becomes lower than the atmospheric pressure, the outlet check valve 48 is closed and the inlet check valve 47 is opened, so that the mobile phase solvent flows into the pump chamber 40*a*. When the inner pressure in the pump chamber 40*a* becomes higher than the atmospheric pressure, the outlet check valve 48 is opened and the inlet check valve 47 is closed, so that the mobile phase solvent is ejected from the pump chamber 40*a* to the column side.

In another conventional liquid transfer pump used in a liquid chromatography, as shown in FIG. 4, a plunger rod 52*a* is fixed, i.e. adhered, to a plunger holder 52, and the plunger holder 52 is screwed or fixed to a cross head 55. Also, the plunger rod 52*a* passes through a plunger seal 53 attached to a side of a pump head 51 and is held thereat, so that the mobile phase solvent does not leak therethrough.

On the other hand, whether or not axial centers of the plunger rod 52*a* and the cross head 55 coincide with each other depends on accuracy in the mechanical processing for the plunger rod 52*a*, plunger holder 52 and cross head 55. Thus, if the accuracy of the mechanical processing is not good, an improper or excessive force is applied from the plunger rod 52*a* to the plunger seal 53, which affects a bad influence to the life of the plunger seal 53.

Namely, the life of the plunger seal 53 depends on the accuracy of the mechanical processing of the plunger rod 52*a* and the plunger holder 52, and is not stable.

The present invention has been made in view of the above problems, and an object of the invention is to provide a liquid transfer pump, wherein axial centers of a plunger and a plunger seal always coincide with each other by a free movement of the plunger in the radial directions, so that an improper or excessive force is not applied to the plunger seal. Namely, in the liquid transfer pump of the invention, it is possible to prolong the life of the plunger seal without requiring the accuracy of the mechanical processing, and the possibility of leakage through the seal is lowered.

SUMMARY OF THE INVENTION

The invention solves the conventional problems, and a liquid transfer pump of the invention comprises a driving mechanism; a housing situated near the driving mechanism and having an inner space; a cross head disposed in the inner space of the housing and attached to the driving mechanism to reciprocate inside the housing, the cross head having a plunger holder at one side thereof; a plunger attached to and held by the plunger holder; and a pump head situated near the cross head and having a pump chamber with an inlet path and an outlet path. The plunger is disposed in the pump chamber and reciprocated therein together with the cross head.

In the invention, a resilient O-ring is disposed in the plunger holder, and a plunger seal is disposed in the pump head. One side of the plunger is engaged with and held by the resilient O-ring, and the other side of the plunger is engaged with and held by the plunger seal to thereby flexibly support the plunger.

The plunger may be formed of one member. However, the plunger may include a main portion situated in the plunger holder, and a plunger rod fixed to the main portion and located in the pump chamber. In this case, the main portion is held by the O-ring, and the plunger rod is held by the plunger seal.

The liquid transfer pump may further include a head holder situated between the housing and the pump head and receiving the plunger holder therein, and a diaphragm having an inner periphery sandwiched between the cross head and the plunger holder, and an outer periphery sandwiched between the housing and the head holder to form a space inside the head holder. The head holder includes an inlet and an outlet communicating with the space in the head holder for cleaning the same.

The liquid transfer pump further includes a cleaning system having a cleaning tank containing a cleaning liquid, inlet and outlet pipes attached to the cleaning tank and connected to the inlet and outlet, respectively, and check valves attached to the respective inlet and outlet pipes. When the cross head is reciprocated, the cleaning liquid is supplied to the space through the inlet pipe and inlet, and is returned to the cleaning tank through the outlet and outlet pipe to thereby clean the space in the head holder.

DETAILED DESCRIPTION OF A PREFERRED EMBODIMENT

Figure 1:
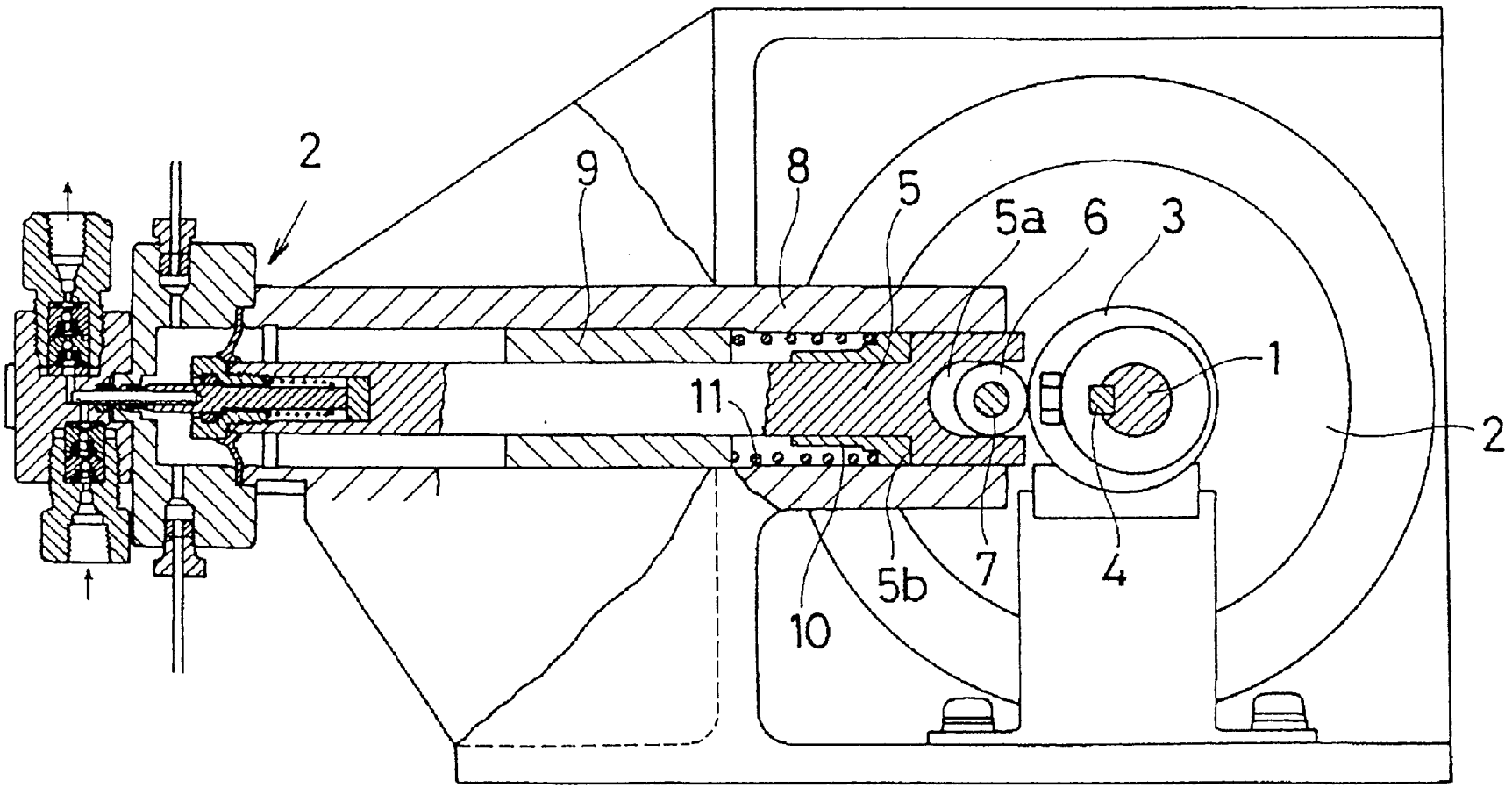
FIG. 1 is an explanatory sectional view for showing an inside structure of a reciprocating driving mechanism and a pump head of a liquid transfer pump of the invention.
Figure 2:
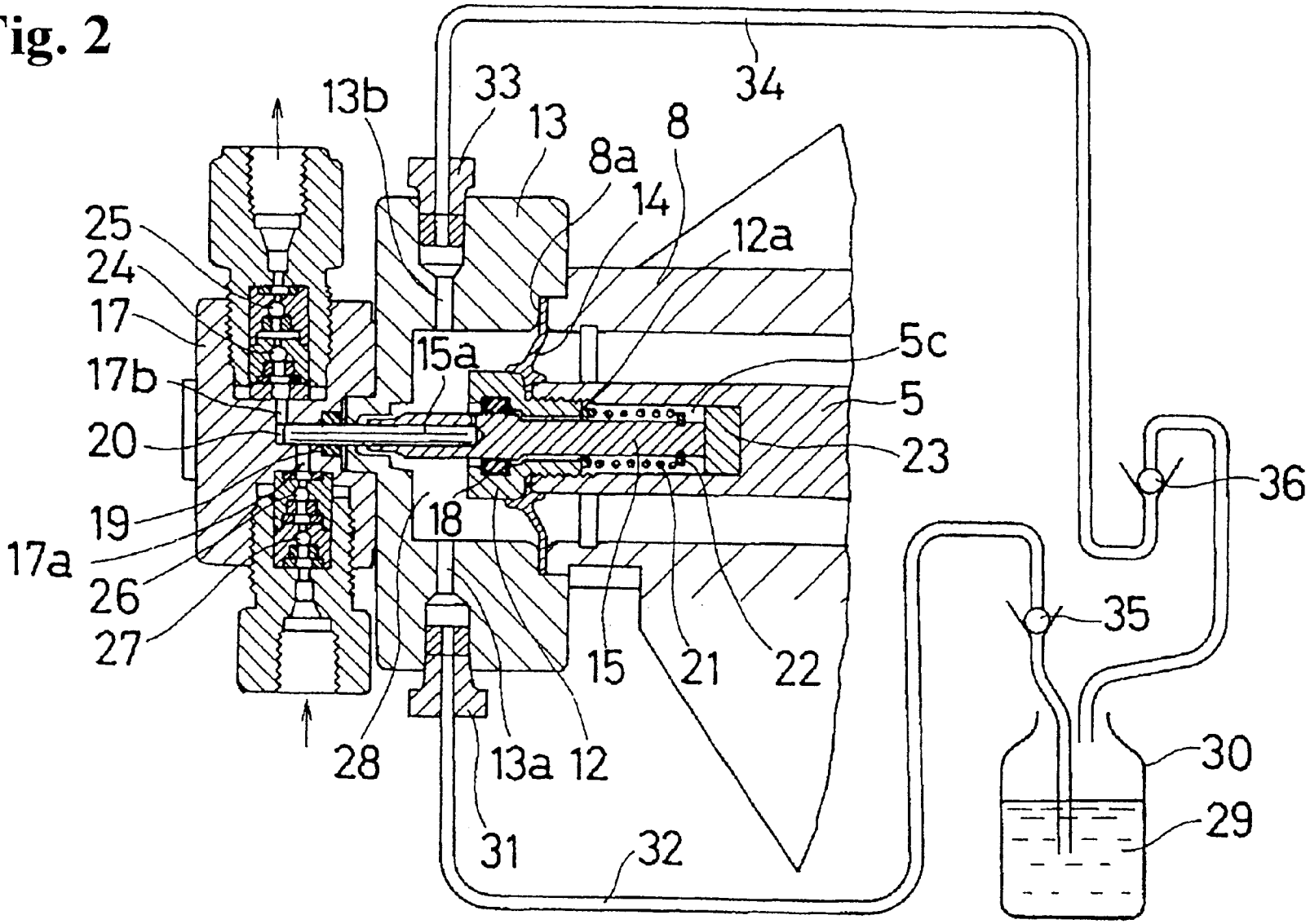
FIG. 2 is an enlarged sectional view of portion 2 in FIG. 1, showing the inside structure of the pump head of the liquid transfer pump of the invention.
Figure 3:
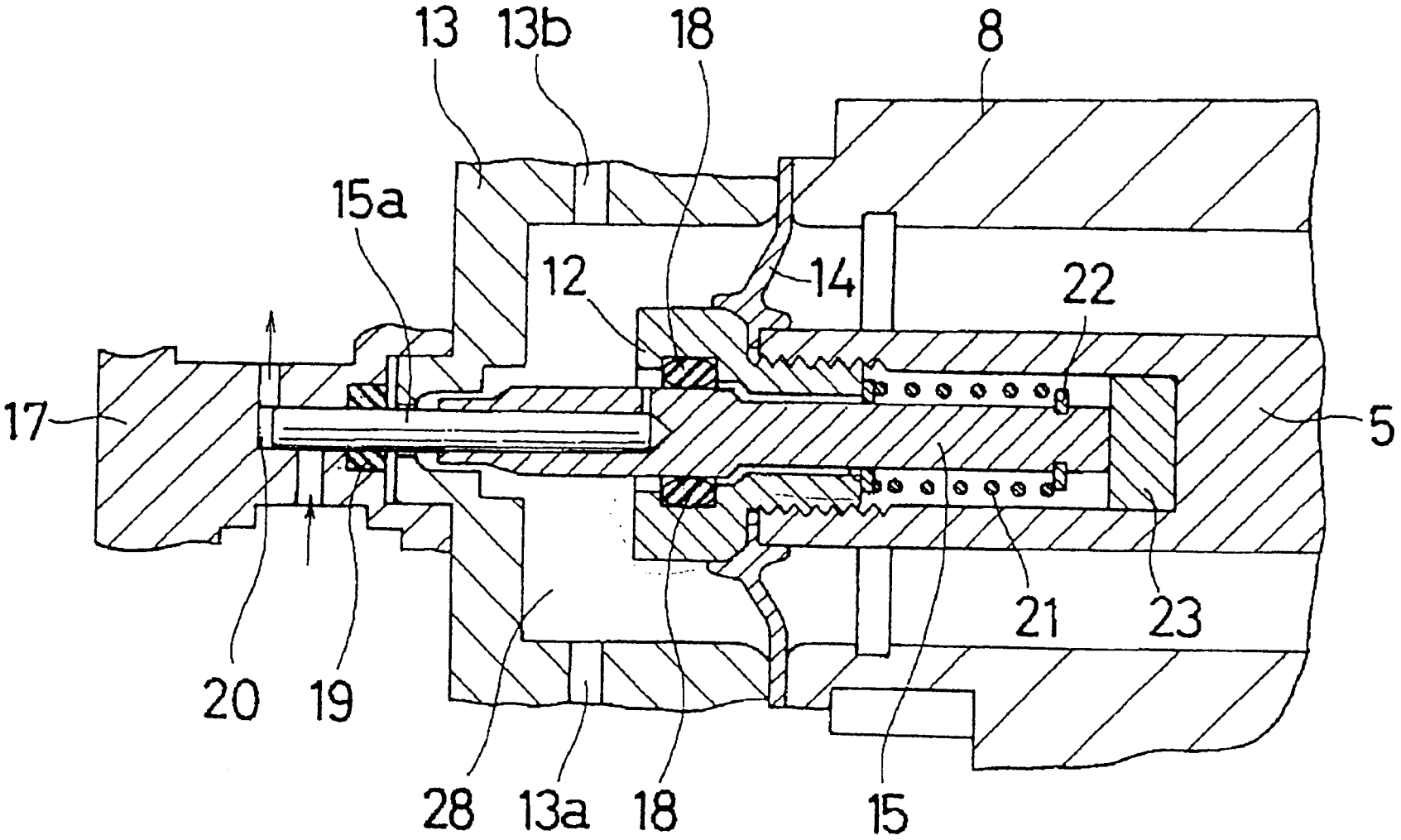
FIG. 3 is a further enlarged sectional view of a part of FIG. 2.
Figure 4:
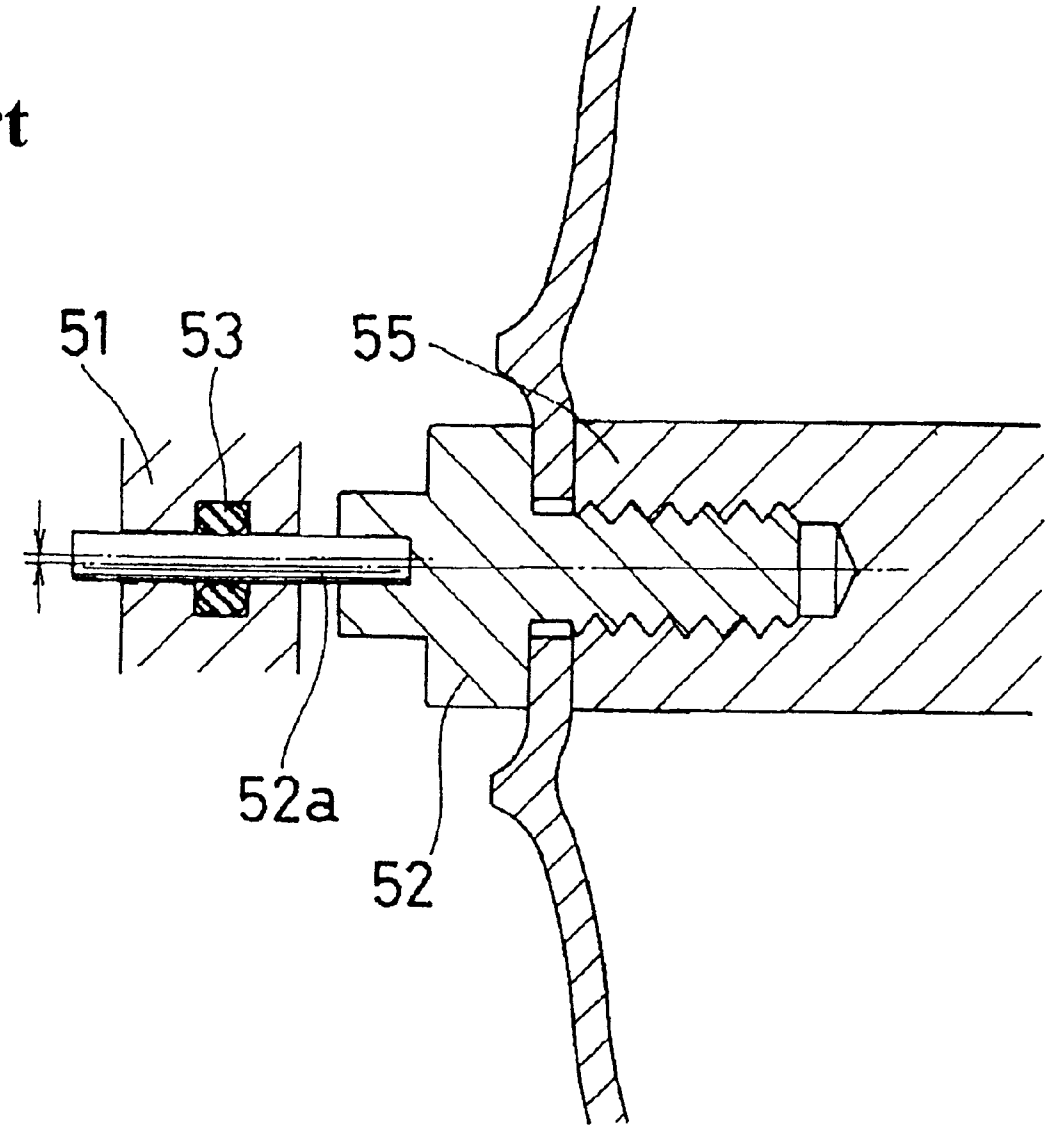
Fig. 4 Prior Art
FIG. 4 is an explanatory sectional view for showing a structure of a cross head, plunger and plunger rod of a conventional liquid transfer pump.
Figure 5:
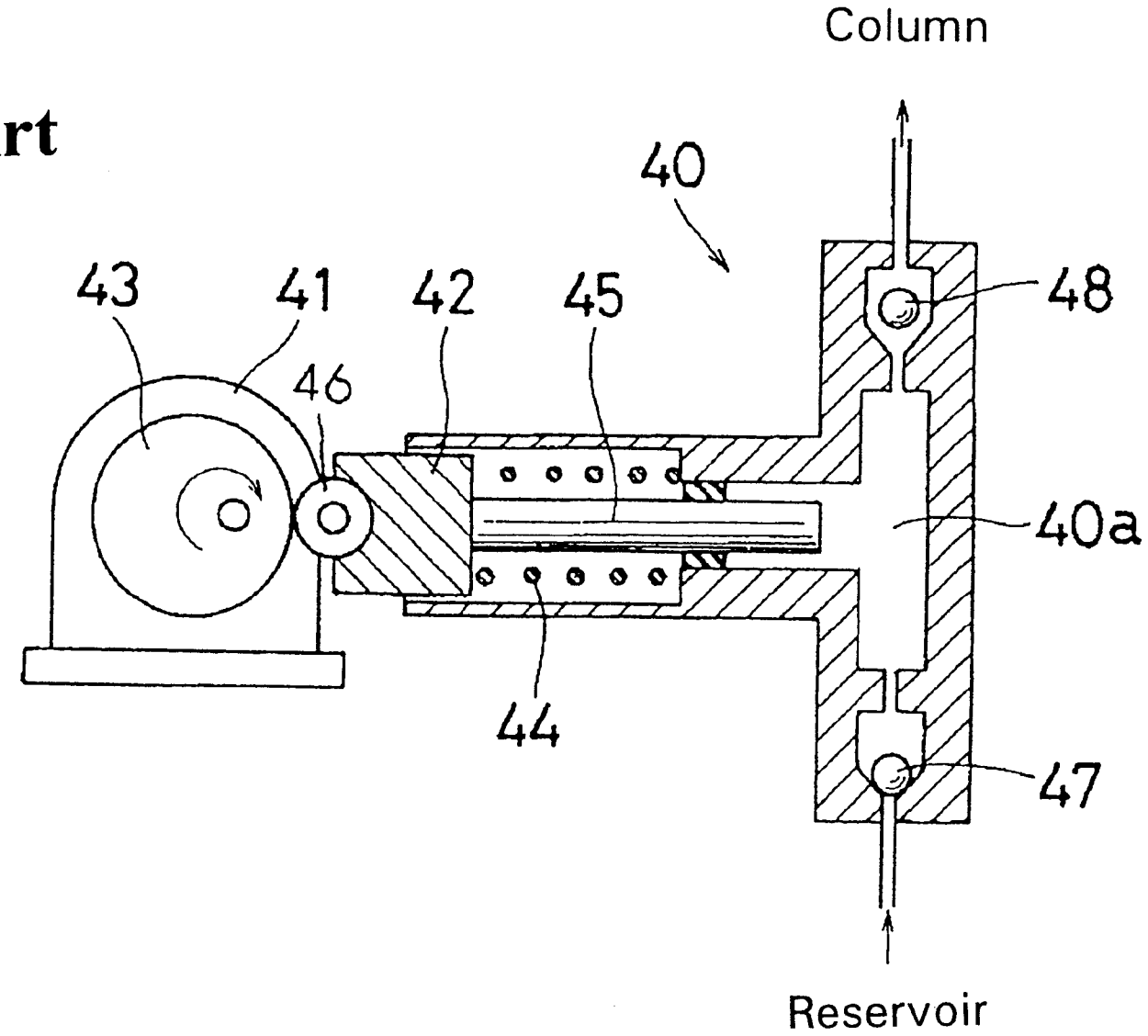
Fig. 5 Prior Art
FIG. 5 is a partial sectional view for showing a principle of a conventional piston type fixed flow amount pump or metering pump used in a liquid chromatography.

Hereinunder, an actual embodiment of the invention will be explained with reference to the drawings. FIG. 1 shows an inside structure of a reciprocating driving mechanism and a pump head of a liquid transfer pump of the invention; FIG. 2 is an enlarged sectional view of a portion 2 in FIG. 1; and FIG. 3 is a further enlarged sectional view of a part of FIG. 2.

In the liquid transfer pump, an eccentric cam 3 is fixed to a driving shaft 1 of a motor 2 by means of a key 4. The eccentric cam 3 contacts a cam follower 6, which is located in a concave 5*a* formed at an end of a cross head or piston 5 and is engaged with a pin 7. The cross head 5 is urged in the direction of the eccentric cam 3 by a return spring 11 situated between a stroke bearing 9 situated in a housing 8 and a spring metal seat 10 situated on a step 5*b* of the cross head 5. Thus, the cross head or piston 5 reciprocates inside the housing 8 according to the rotation of the motor 2.

A plunger holder 12 is fixed or screwed to a front end of the cross head 5. A head holder 13 is attached to an end of the housing 8. An outer periphery of a diaphragm 14 is sandwiched and fixed between the end of the housing 8 and the head holder 13, and an inner periphery of the diaphragm 14 is sandwiched and sealingly fixed between the cross head 5 and the plunger holder 12. As shown in the drawings, the cross head 5 and the plunger holder 12 are fixed by screwing, while the plunger 15 is movably held inside the plunger holder 12, as explained later. A plunger rod 15*a* is integrally adhered to a front end of the plunger 15. An O-ring 18 is situated at an end portion of the plunger holder 12 to seal the plunger 15.

A pump head 17 is attached to a front end of the head holder 13. Inside the pump head 17, an inlet path 17*a* for a mobile phase or liquid, an outlet path 17*b* and a pump chamber 20 are formed. The plunger rod 15*a* is situated in the pump chamber 20 to reciprocate therein. A plunger seal 19 is attached to the pump head 17, so that the plunger rod 15*a* is sealed by the plunger seal 19.

Thus, the rear portion of the plunger 15 is sealed by the O-ring 18, and the plunger rod 15*a* located at the front portion of the plunger 15 is held by the plunger seal 19.

In order to reduce a play at a holding section of the plunger 15 to zero, an E-ring 22 is attached to the plunger 15, and a spring 21 is disposed between the E-ring 22 and the plunger holder 12 to thereby urge the plunger 15 to the side of the cross head 5 at all times. Thus, the plunger 15 is attached to the plunger holder 12 slightly movably. Since a large force is applied to a contact face at the rear portion of the plunger 15, the plunger 15 is made of steel and is processed by quenching. Also, a thrust or plate 23 made of steel and processed by quenching is located at a side of the cross head 5 to reduce or prevent wearing of the contact face of the cross head. A lubricating agent, such as grease, molybdenum disulfide and so on, is coated at a contact portion between the plunger 15 and the thrust 23.

In the liquid transfer pump with the structure as stated above, when the cross head 5 is driven by the eccentric cam 3, the plunger 15 reciprocates to thereby increase or decrease the pressure inside the pump chamber 20 relative to the atmospheric pressure, so that the mobile phase solvent is transferred. Namely, when the inner pressure of the pump chamber 20 becomes less than the atmospheric pressure by the reciprocal movement of the plunger 15, outlet check valves 24, 25 are closed and inlet check valves 26, 27 are opened to thereby allow the mobile phase solvent to enter into the pump chamber 20. Also, when the inner pressure in the pump chamber 20 becomes more than the atmospheric pressure, the outlet check valves 24, 25 are opened, and the inlet check valves 26, 27 are closed to thereby eject the mobile phase solvent from the pump chamber 20 to the column side.

A space 28 located at the end of the housing 8 and formed between head holder 13 and the plunger holder 12 is sealed securely by the O-ring 18 and the plunger seal 19, and a capacity of the space 28 is changed since the diaphragm 14 is moved in the axial direction according to the movements in the axial direction of the plunger 15.

On the other hand, one path 13*a* communicating with the space 28 of the head holder 13 is connected to an inner passing type plug 31 connected to a pipe 32 immersed into a cleaning liquid 29 in a cleaning liquid tank 30. The other path 13*b* communicating with the space 28 of the head holder 13 is connected to an inner passing type plug 33 connected to a pipe 34 disposed at one end in an inner space of the cleaning liquid tank 30. The pipe 32 has a check valve 35 for allowing the cleaning liquid to flow to the space 28 of the pump head 13 and preventing the cleaning liquid from flowing in the reverse direction. Also, the pipe 34 has a check valve 36 for allowing the cleaning liquid to flow to the cleaning tank 30 and preventing the cleaning liquid from flowing in the reverse direction. Thus, the cleaning liquid can be supplied to the space 28 in the pump head 13 by reciprocating the plunger 15 to clean the space 28.

The mobile phase liquid and the cleaning liquid are transferred by the reciprocal movements of the plunger 15. However, in the process of the reciprocal movements, since the plunger 15 with the plunger rod 15*a* is held by the O-ring 18 and the plunger seal 19, it is possible to flexibly operate even if the axial centers of the cross head 5 and the plunger 15 do not coincide with each other. Since the excessive or improper force is not applied to the plunger seal 19 when the plunger 15 reciprocates, the plunger 19 and the O-ring 18 are not damaged, and leakage does not occur. Incidentally, the above O-ring 18 may be formed of a resilient material with a sealing ability, and it may have a shape other than the O-ring. Also, the material of the O-ring 18 may be rubber or fluoro resin rubber.

As stated above, in the liquid transfer pump of the invention, even if the axial centers of the plunger and the cross head do not accord or coincide with each other, it is possible to flexibly reciprocate the plunger and the plunger rod in conformity with the axial center of the plunger seal. Accordingly, an excessive or improper force is not applied to the plunger seal, so that the life of the plunger seal can be prolonged. Also, since the plunger seal and the O-ring are formed, the cleaning liquid does not enter the contact face between the plunger and the cross head. Further, since the liquid transfer pump does not require precise mechanical processing in forming the plunger, cross head and so on, the cost for the liquid transfer pump can be reduced.

While the invention has been explained with reference to the specific embodiment of the invention, the explanation is illustrative and the invention is limited only by the appended claims.

What is claimed is:

1. A liquid transfer pump, comprising:

a driving mechanism, a housing situated near the driving mechanism and having an inner space, a cross head disposed in the inner space of the housing and attached to the driving mechanism to reciprocate inside the housing, said cross head having a plunger holder at one side thereof, a plunger attached to and held by the plunger holder, a pump head situated near the cross head and having a pump chamber with an inlet path and an outlet path, said plunger being disposed in the pump chamber and reciprocated therein together with the cross head, and a resilient O-ring disposed in the plunger holder and a plunger seal disposed in the pump head, one side of the plunger being engaged with and held by the resilient O-ring and the other side of the plunger being engaged with and held by the plunger seal to thereby flexibly support the plunger.

2. A liquid transfer pump according to claim 1, further comprising a space situated between the plunger and the plunger holder, and a spring disposed between the plunger and the plunger holder to urge the plunger in a direction away from the pump head so that the plunger abuts against the cross head and is held stably in the plunger holder.

3. A liquid transfer pump according to claim 2, wherein said cross head has a hole for receiving a part of the plunger therein, said spring being disposed around the plunger and situated inside the hole.

4. A liquid transfer pump according to claim 1, further comprising a head holder situated between the housing and the pump head and receiving the plunger holder therein, and a diaphragm having an inner periphery sandwiched between the cross head and the plunger holder, and an outer periphery sandwiched between the housing and the head holder to form a space inside the head holder, said plunger passing through the head holder and entering into the pump chamber of the pump head.

5. A liquid transfer pump according to claim 4, wherein said head holder includes an inlet and an outlet communicating with the space in the head holder for cleaning the same.

6. A liquid transfer pump according to claim 5, further comprising a cleaning system having a cleaning tank containing a cleaning liquid, inlet and outlet pipes attached to the cleaning tank and connected to the inlet and outlet of the head holder, respectively, and check valves attached to the respective inlet and outlet pipes so that when the cross head is reciprocated, the cleaning liquid is supplied from the cleaning tank to the space through the inlet pipe and inlet and is returned to the cleaning tank through the outlet and outlet pipe.

7. A liquid transfer pump according to claim 1, wherein said plunger includes a main portion situated in the plunger holder, and a plunger rod fixed to the main portion and located in the pump chamber.

8. A liquid transfer pump according to claim 1, wherein said pump transfers a mobile phase in a liquid chromatography through the inlet and outlet paths.

* * * * *